US008670016B2

(12) United States Patent
Suto et al.

(10) Patent No.: US 8,670,016 B2
(45) Date of Patent: Mar. 11, 2014

(54) EXPOSURE DEVICE AND IMAGE FORMING DEVICE HAVING A FIXING MEMBER FOR FIXING AN OPTICAL SYSTEM MEMBER

(75) Inventors: Akira Suto, Tokyo (JP); Yo Kishikawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 90 days.

(21) Appl. No.: 13/232,210

(22) Filed: Sep. 14, 2011

(65) Prior Publication Data

US 2012/0062686 A1 Mar. 15, 2012

(30) Foreign Application Priority Data

Sep. 15, 2010 (JP) ..... 2010-206629

(51) Int. Cl.
*B41J 15/14* (2006.01)
*B41J 27/00* (2006.01)

(52) U.S. Cl.
USPC ..... 347/242; 347/257

(58) Field of Classification Search
USPC ..... 347/241, 242, 244, 256–258
See application file for complete search history.

(56) References Cited

U.S. PATENT DOCUMENTS 6,801,232 B2 * 10/2004 Nagamine et al. ..... 347/149
7,151,871 B2 * 12/2006 Tanaka ..... 385/33
7,245,574 B2 * 7/2007 Kamisada et al. ..... 369/121
7,463,275 B2 * 12/2008 Nakamura et al. ..... 347/224

FOREIGN PATENT DOCUMENTS

JP 2005300583 A * 10/2005 ..... G03B 27/32
JP 2008093886 A * 4/2008 ..... B41J 2/44
JP A-2010-64426 3/2010

* cited by examiner

*Primary Examiner* — Hai C Pham
(74) *Attorney, Agent, or Firm* — Muncy, Geissler, Olds & Lowe, P.C.

(57) ABSTRACT

An exposure device includes: an optical system member that causes light irradiated from a light emitting element to converge; an optical system support part that supports the optical system member; and a fixing member for fixing the optical system member to the optical system holding part. An elongation of the fixing member is in a range of 40% to 80% inclusive.

23 Claims, 9 Drawing Sheets

EXPOSURE DEVICE AND IMAGE FORMING DEVICE HAVING A FIXING MEMBER FOR FIXING AN OPTICAL SYSTEM MEMBER

CROSS REFERENCE TO RELATED APPLICATION

The present application is related to, claims priority from and incorporates by reference Japanese patent application No. 2010-206629, filed on Sep. 15, 2010.

TECHNICAL FIELD

The present application relates to an image forming device and an exposure device, such as a light emitting diode (LED) head or the like, that is used in the image forming device.

BACKGROUND

Conventionally, for image forming devices, such as printers, photocopy machines, facsimile machines, multifunction machines and the like, an exposure device, such as an LED head or the like, used in printers, for example, exposes a charged photosensitive drum by irradiating light thereto and forms an electrostatic latent image on the photosensitive drum. A conventional exposure device includes a lens holder, a substrate on which an LED array is mounted by being held by the lens holder, a rod lens array that is held by the lens holder so as to face the LED array and that causes the light irradiated from the LED array to converge. The electrostatic latent image is formed as the light irradiated from the LED array mounted on the substrate converges through the rod lens array and exposes the photosensitive drum arranged at an image forming position of the rod lens array (see, for example, Japanese Laid-Open Patent Application No. 2010-64426 (pages 3 and 6, FIG. 1)).

Here, for fixing the rod lens array on the lens holder, the rod lens array must be fixed while maintaining highly precise straightness. Therefore, the rod lens array is fixed on the lens holder by using an adhesive (e.g., UV adhesive) that is adherable in a short period of time, while straitening the rod lens array using a jig that has a rod lens array contact surface with a high degree of straightness.

However, in the exposure device with the above-described configuration, there are cases where the rod lens array warps toward the photosensitive drum and where the adhesive between the lens holder and the lens array peels, when the exposure device is left in a high temperature environment. As a result, print quality may be decreased because the image forming condition of the light with respect to the photosensitive drum changes and thereby good electrostatic latent images are not obtained.

SUMMARY

An exposure device disclosed in the application includes: an optical system member that causes light irradiated from a light emitting element to converge; an optical system support part that supports the optical system member; and a fixing member for fixing the optical system member to the optical system holding part. An elongation of the fixing member is in a range of 40% to 80% inclusive, and hardness (Shore D) of the fixing member is in a range of 40 to 90 inclusive.

Another exposure device disclosed in the application includes: an optical system member that causes light irradiated from a light emitting element to converge; an optical system support part that supports the optical system member; and a fixing member for fixing the optical system member to the optical system holding part. The optical system support part holds sliding parts that is arranged in correspondence with both end parts of the optical system member at a vicinity of the both end parts and that is slidable in a longitudinal direction, and the vicinity of the both end parts of the optical system member is fixed to the sliding parts by the fixing member, and a vicinity of a center part of the optical system member is directly fixed to a main body of the optical system support part by the fixing member.

Another exposure device includes: an optical system member that causes light irradiated from a light emitting element to converge; an optical system support part that supports the optical system member; and a fixing member for fixing the optical system member to the optical system holding part, the fixing member having a predetermined property of elongation and hardness (Shore D) that maintains a straightness of the optical system member when the optical member and the optical system support part are fixed by the fixing member even in a high temperature environment. The fixing member is applied between the optical system member and the optical system support part, including at least a vicinity of both end parts and a center part of the optical system member, at approximately equal intervals.

According to the exposure device of the present application, the excellent image forming condition of the light with respect to the photosensitive drum is maintained even when the environmental temperature changes.

DETAILED DESCRIPTION OF EMBODIMENTS

First Embodiment

Figure 1:
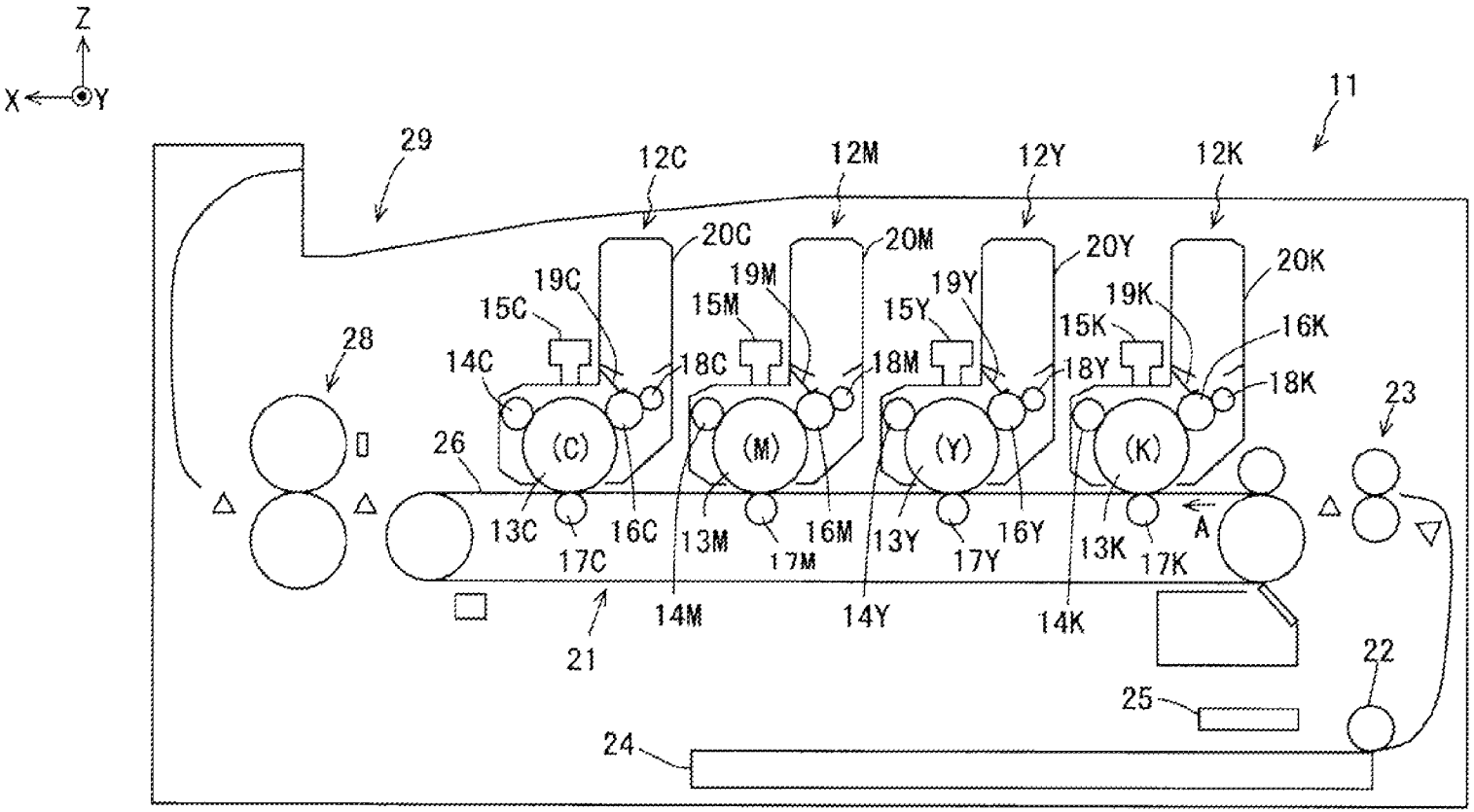
FIG. 1 is a main part configuration diagram schematically illustrating a main part configuration of the main parts of an image forming device of a first embodiment including an LED head as the exposure device according to this application.

FIG. 1 is a main part configuration diagram schematically illustrating a configuration of the main parts of an image forming device of a first embodiment including an LED head as the exposure device according to this application.

An image forming device 11 has a configuration as an electrographic color printer, for example, in which image forming units 12K, 12Y, 12M and 12C that configures four independent image forming parts (maybe simply referred to as an image forming unit 12 unless specifically distinguished) are arranged from an insertion side to an exist side of a sheet as a recording medium. The image forming unit 12K forms an image in black (K). The image forming unit 12Y forms an image in yellow (Y). The image forming unit 12M forms an image in magenta (M). The image forming unit 12C forms an image in cyan (C). In addition to the sheets, over head projector (OHP) sheets, envelops, copying paper, special paper and the like may be used as the recording medium.

In each of the image forming units 12K, 12Y, 12M and 12C, photosensitive bodies (e.g., photosensitive drums) 13K, 13Y, 13M and 13C (maybe simply referred to as a photosensitive drum 13 unless specifically distinguished) as image carriers, charging rollers 14K, 14Y, 14M and 14C (maybe simply referred to as a charging roller 14 unless specifically distinguished) that uniformly and equally charge surfaces of the corresponding photosensitive drums 13K, 13Y, 13M and 13C, development rollers 16K, 16Y, 16M and 16C (maybe simply referred to as a development roller 16 unless specifically distinguished) as developer carriers that form toner images, which are visible images, in each color by attaching developers (e.g., toners) (not shown) on electrostatic latent images formed on the surfaces of the corresponding photosensitive drums 13K, 13Y, 13M and 13C, and toner supply rollers 18K, 18Y, 18M and 18C (maybe simply referred to as a toner supply roller 18 unless specifically distinguished) as developer supply members that supply the developer by pressing the developer against the corresponding development rollers 16K, 16Y, 16M and 16C are respectively arranged.

The toner supply rollers 18K, 18Y, 18M and 18C respectively supply to the corresponding development rollers 16K, 16Y, 16M and 16C toner of the respective colors supplied from corresponding toner cartridges 20K, 20Y, 20M and 20C (maybe simply referred to as a toner cartridge 20 unless specifically distinguished). To the development rollers 16K, 16Y, 16M and 16C, development blades 19K, 19Y, 19M and 19C (maybe simply referred to as a development blade 19 unless specifically distinguished) that correspond thereto are pressed against the development rollers 16K, 16Y, 16M and 16C, respectively. The development blade 19 forms on the development roller 16 a thin layer of the toner supplied from the toner supply roller 18.

Above the photosensitive drums 13K, 13Y, 13M and 13C respectively in the image forming units 12K, 12Y, 12M and 12C, LED heads 15K, 15Y, 15M and 15C (maybe simply referred to as an LED head 15 unless specifically distinguished), as the exposure devices that correspond to the photosensitive drums 13K, 13Y, 13M and 13C, are arranged to face the photosensitive drums 13K, 13Y, 13M and 13C, respectively. Each LED head 15 is a device that exposes the photosensitive drum 13 and forms an electrostatic latent image in accordance with image data for the corresponding color.

Figure 2:
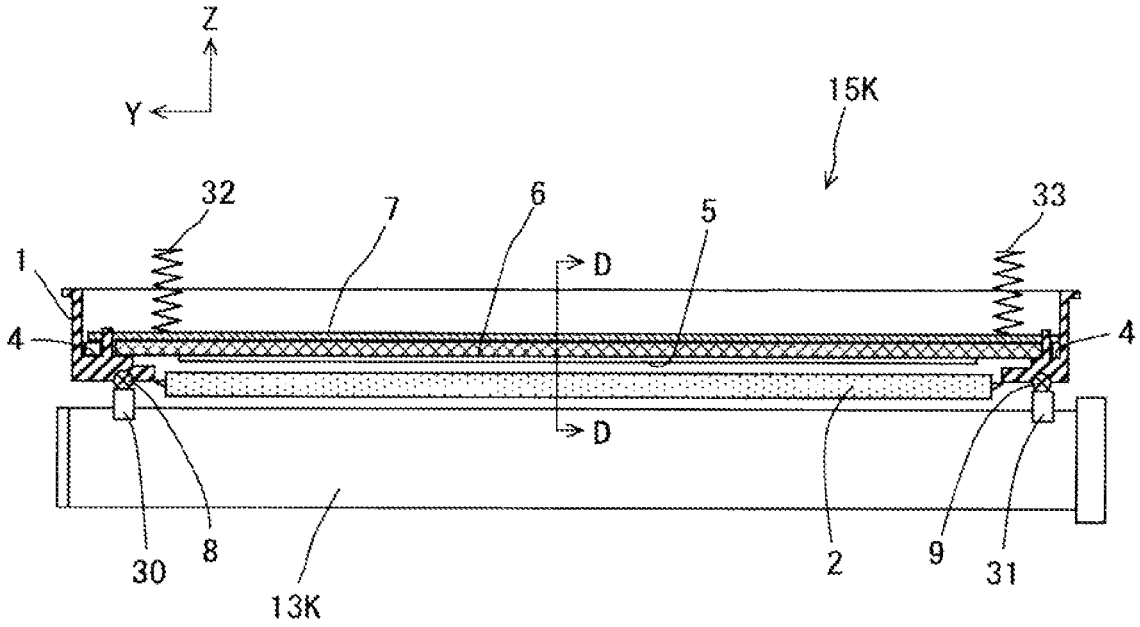
FIG. 2 is a main part configuration diagram showing the main part configuration of the LED head of the first embodiment from a minus side of the X axis in conjunction with the photosensitive drum.
Figure 3:
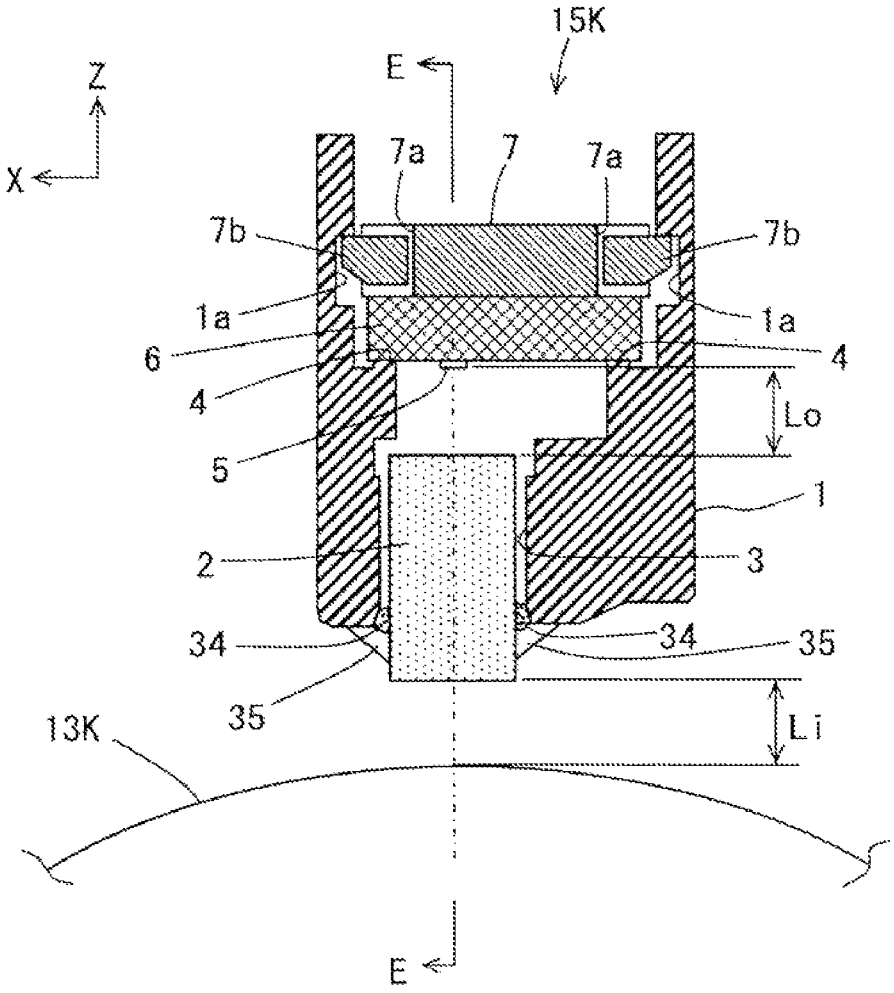
FIG. 3 is a main part configuration diagram showing the main part configuration of the LED head of the first embodiment from a positive side of a Y axis in conjunction with the photosensitive drum.

The four LED heads 15 have the same internal configuration. As shown in FIGS. 2 and 3 discussed later, each LED head 15 is configured from an LED array chip 5 that includes a plurality of light emitting elements, a substrate 6 on which the LED array chip 5 is mounted, an lens array 2 as an optical system member that causes the light irradiated from the LED array chip 5 to converge, a lens holder 1 as an optical system support part that supports the substrate 6 and the lens array 2, and a base 7 as a pressure member for pressing the substrate 6 against substrate contact surfaces 4 inside the lens holder 1.

A transfer unit 21 is arranged below each of the photosensitive drum 13 of the four image forming units 12. The transfer unit 21 includes transfer rollers 17K, 17Y, 17M and 17C (maybe simply referred to as a transfer roller 17 unless specifically distinguished) as transfer devices, and a carrying belt 26 as a carrying member arranged travelablly in a direction of arrow A in FIG. 1. Each transfer roller 17 is arranged to face the corresponding photosensitive drum 13 across a carrying belt 26 and superimposes and transfers a toner image in the corresponding color formed on the corresponding photosensitive drum 13 sequentially on a sheet, by charging the sheet with a polarity opposite from that of the toner.

In FIG. 1, the X axis is in a carrying direction in which a print medium passes through each image forming unit 12, the Y axis is in a direction of a rotational shaft of each photosensitive drum 13, and the Z direction is in a direction orthogonal with the X and Y axes. In addition, when each of the X, Y and Z axes is indicated in other figures discussed later, the direction of the axis indicates a common direction. That is, the X, Y and Z directions in each figure indicate arrangement directions of the parts drawn in the figure when such parts configure the image forming device 11 shown in FIG. 1. In addition, here, the Z axis is arranged in an approximately vertical direction extending from the bottom to the top of the sheet of FIG. 1.

In a lower part of the image forming device 11, a sheet supply mechanism is arranged for supplying sheets to the carrying belt 26. The sheet supply mechanism includes a hopping roller 22, a registration roller pair 23, a sheet storage cassette 24 as a medium storage part, and a sheet color colorimetry part 25 that measures color of the sheets in thee sheet storage cassette 24.

Moreover, a fuser 28 is provided at the ejection side of the carrying belt 26. The fuser 28 includes a heat roller and a backup roller and is a device to fix the toner transferred onto the sheet by pressure and heat. At an exit side of the fuser 28, ejection rollers, pinch rollers, a sheet stacker part 29 and the like (not shown) are provided.

The print operation of the image forming device 11 with the above-described configuration is briefly explained. First, each sheet in the sheet storage cassette 24 is fed by the hopping roller 22, and an offset of the sheet is corrected as the sheet is forwarded to the registration roller 23. Next, the sheet is forwarded from the registration roller 23 to the carrying belt 26. Then, the sheet is carried sequentially to the image forming units 12K, 12Y, 12M and 12C in accordance of the traveling of the carrying belt 26.

In the mean time, in each image forming unit 12, after being charged by the charging roller 14, the surface of the photosensitive drum 13 is exposed by the corresponding LED head 15. By this exposure, an electrostatic latent image is formed on the surface of the photosensitive drum 13. At a part of the photosensitive drum 13 where the electrostatic latent image is formed, a toner image is formed in the corresponding color as the toner, which has been formed as a thin layer on the development roller 16, electrostatically attaches to the part. The toner image formed on each photosensitive drum 13 is sequentially transferred to, and superimposed on, the sheet by the corresponding transfer roller 17. The toner that remains on each photosensitive drum 13 after the transfer is removed by a cleaning device (not shown).

The sheet, on which the color toner image has been formed, is sent to the fuser 28. At the fuser 28, the color toner image is fixed on the sheet to form a color image. The sheet, on which the color image has been formed, is pinched by the ejection rollers and pinch rollers (not shown) and is ejected to the sheet stacker part 29. Through the above-described processes, the color image is formed on the sheet.

FIG. 2 is a main part configuration diagram showing a main part configuration of the LED head 15 of the first embodiment from a minus side of the X axis in conjunction with the photosensitive drum 13. FIG. 3 is similarly a main part configuration diagram from a positive side of the Y axis. In addition, FIG. 2 illustrates primarily a configuration at an E-E cross-section in FIG. 3, and FIG. 3 illustrates primarily a configuration at a D-D cross section in FIG. 2. The LED head 15 is further explained with reference to these figures. Because the four LED heads 15 have the same configuration and because the positional relationship with the respective photosensitive drums 13 is the same, the LED head 15K for black (K) is explained as an example.

As shown in FIGS. 2 and 3, the LED head 15K is arranged to face the photosensitive drum 13K. The LED head 15K includes the lens holder 1 as an optical system support part that is formed in a longitudinal direction (here, the Y axis direction) of the LED head 15K and that has a groove part in which both sides are closed. At the center of the lens holder 1, an opening 3 is formed along the longitudinal direction for mounting the lens array 2.

Moreover, the substrate 6, on which the LED array chip 5 is mounted in which a plurality of LEDs are linearly arranged as light emitting elements, is arranged so that the LED array chip 5 extends along the longitudinal direction of the LED head 15K and is supported in a state where both ends of the substrate 6 in the lateral direction are in contact with the substrate contact surfaces 4 (FIG. 3) formed in the entire area of the lens holder 1 in the longitudinal direction. The substrate 6 is fixed by a base 7, which is a pressing material, that presses the substrate 6 against the substrate contact surfaces 4.

The base 7 is a plate shaped member that covers approximately the entire facing surface of the substrate 6. On both ends of the base 7 in the lateral direction, U-shaped cutouts 7*a* are formed at positions opposite from each other at a plurality of locations in the longitudinal direction. As shown in FIG. 3, to the cutouts 7*a*, hooks 7*b*, which are restricted at positions to project from both sides of the base 7, are arranged in a state where the hooks 7 are urged in the projection direction by an urging member and a restriction member (not shown). In the meantime, engagement grooves 1*a*, in which the hooks 7*b* intrude, are formed at positions facing the cutouts 7*a* of the lens holder 1. Therefore, when the base 7 is installed, the base 7 is pressed down such that a taper part of each hook 7*b* intrudes from the above at a position to hook the groove of the lens holder 1. At this time, the hook 7*b* retracts inwardly in response to the urging and moves downwardly while sliding on an inner surface of the lens holder 1. Then, the base 7 contacts the substrate 6. As the hook 7*b* intrudes inside the engagement groove 1*a* at a position where the base is pressed downwardly, the base 7 is fixed in the lens holder 1 as shown in FIG. 3. As discussed later, the lens array 2 is arranged at a predetermined position of the opening 3 of the lens holder 1 and is fixed in the lens holder 1 at plural locations by an adhesive 34 as a fixing member.

Here, to accurately form an image on the corresponding photosensitive drum 13K by the light emitted from the LED array chip 5, it is necessary to equalize a distance Lo, which is from the LED array chip 5 to an entrance end surface of the lens array 2, and a distance Li, which is from an exit end surface of the lens array 2 to the surface of the photosensitive drum 13K on which the light forms the image (Lo=Li).

Therefore, the lens array 2 is first fixed in the lens holder 1 in the longitudinal direction of the LED head 15 (here, in the Y axis direction) in a state where a highly precise straightness is maintained without fluctuation in the distance Lo from the LED array chip 5 in the entire area of the lens array 2. A method for the fixing is explained later.

On the other hand, the distance Li from the exit end surface of the lens array 2 to the surface of the photosensitive drum 13K on which the light forms the image is configured adjustable by an eccentric cam mechanism as an adjustment mechanism. That is, near both ends of the lens holder 1 in the longitudinal direction, the eccentric cam mechanism as the adjustment mechanism is arranged. Eccentric cams 8 and 9 respectively contact spacers 30 and 31 arranged on the surface of the photosensitive drum 13K. By using the eccentric cam mechanism, the distance Li from the exit end surface of the lens array 2 to the surface of the photosensitive drum 13K on which the light forms the image is adjusted.

Therefore, near both ends of the base 7, a pair of coil springs 32 and 33 are arranged as urging members between the base 7 and predetermined positions (not shown) of the image forming device 1 main body or the image forming unit 12K main body. As shown in FIG. 2, the coil springs 32 and 33 urge the LED head 15K toward the photosensitive drum 13K. The eccentric cams 8 and 9 in which a rotational angle has been adjusted is pressed against a contact surface of the spacers 30 and 31. As such, the distance Li from the exit end surface of the lens array 2 and the surface of the photosensitive drum 13K on which the light forms the image is maintained constant. The eccentric cams 8 and 9 vary the distance between the lens holder 1 that holds the eccentric cams 8 and 9 such that the rotational angles thereof are adjustable, and the spacers 30 and 31 that respectively contact the eccentric cams 8 and 9. However, detailed descriptions are omitted here.

Next, a method is explained below that fixes the lens array 2 in the lens holder 1 in the longitudinal direction (here, in the Y axis direction) of the LED head 15 in a state where a highly precise straightness is maintained without fluctuation in the distance Lo from the LED array chip 5 in the entire area of the lens array 2.

Figure 4:
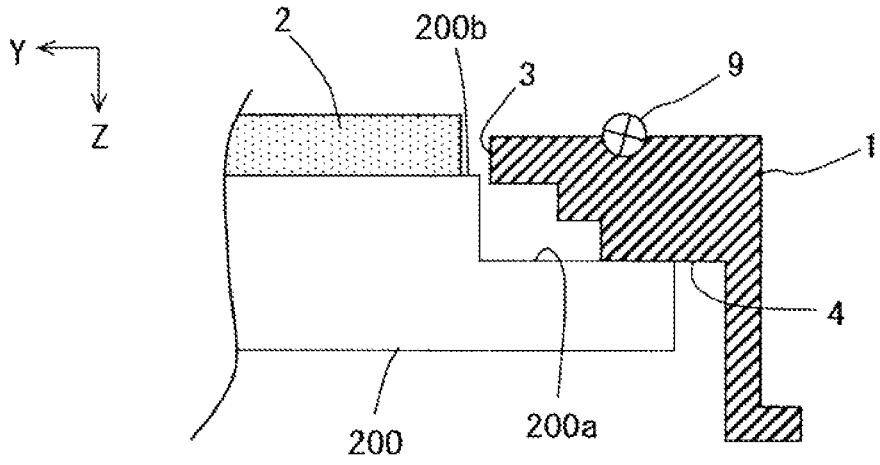
FIG. 4 is a reference diagram for explaining an order to fix a lens array on a lens holder using a lens array adhesion jig.

A lens array adhesion jig 200 is used for fixing the lens array 2 in the lens holder 1. FIG. 4 is a reference diagram for explaining an order for fixing the lens array 2 on the lens holder 1 using a lens array adhesion jig 200 and is a partially enlarged view of an end side of the lens holder 1 in the longitudinal direction at which the eccentric cam 9 is provided.

As shown in the same figure, the lens array adhesion jig 200 includes a reference surface 200*a* on which the substrate contact surface 4 formed on both end parts of the lens holder 1 in the longitudinal direction is mounted as the lens holder 1 is placed upside down, and a lens array contact surface 200*b* on which a surface of the lens array 2 attached to the lens holder 1 that is on a side facing the substrate 5 (FIG. 3) is mounted. The lens array contact surface 200*b* is formed at a predetermined height (e.g., distance Lo+thickness of LED array chip 5) with respect to the reference surface 200*a*, and thereby the straightness of the lens array 2 mounted is created.

Therefore, the highly precise straightness is maintained in the longitudinal direction (Y axis direction in FIG. 4). The thickness of the LED array chip 5 means a height from the surface of the substrate 6 to a light exit surface of the LED array chip 5 when the LED array chip 5 is attached to the substrate 6.

Therefore, to fix the lens array 2 in the lens holder 1, the lens holder 2, to which the substrate 6 and the like have not been installed, covers the lens array adhesion jig 200 so as to accommodate the lens array adhesion jig 200 in the groove part of the lens holder 1 while the lens holder 1 is placed upside down. Then, as shown in FIG. 4, the lens holder 1 is positioned and mounted on the lens array adhesion jig 200 such that the substrate contact surface 4 contacts the reference surface 200*a* at both sides. Next, the lens array 2 to be fixed is mounted on the lens array contact surface 200*b* by inserting the lens array 2 into the opening 3 (see FIG. 3). In addition, to result the highly precise straightness, the lens holder 1 and the lens array 2 are adhered and fixed to each other using an adhesive 34 (here, UV adhesive) that has short hardening time, while the lens array 2 is attached to, straitened and held on, the lens array contact surface 200*b*.

Figure 5:
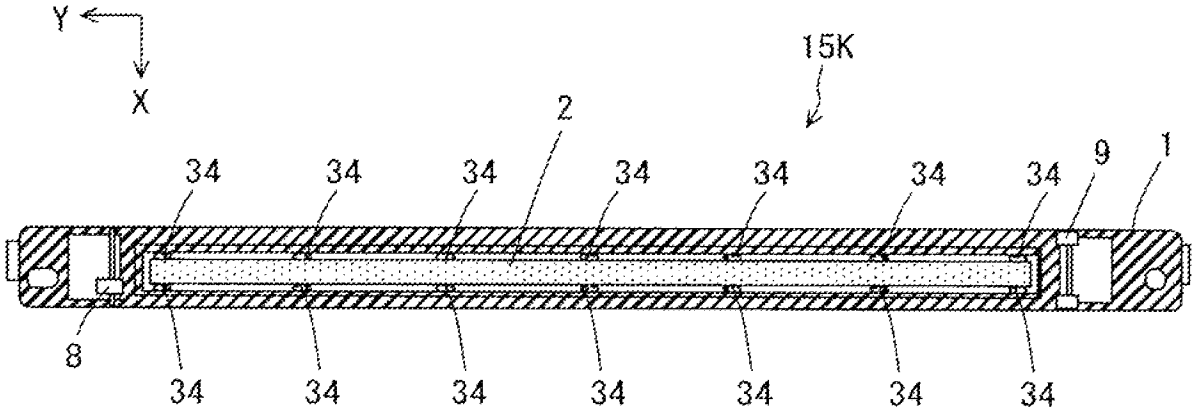
FIG. 5 is a schematic configuration diagram showing a bottom view of the LED head for illustrating adhesion locations of an adhesive in the first embodiment.

FIG. 5 is a schematic configuration diagram showing a view of the LED head 15K from a bottom for illustrating adhesion locations of the adhesive 34. The adhesion location may be referred to as a fixing location.

The adhesion by the adhesive 34 is performed at 7 locations (total of 14 locations) between a lower end part of the opening 3 of the lens holder 1 and the lens array 2 as shown in FIG. 3 and at opposing positions on both sides of the lens array 2 in the lateral direction at approximately equal intervals in the longitudinal direction including both end parts and the center part of the lens array 2, as shown in FIG. 5. After that, to prevent light or a foreign material from flowing onto the LED array chip 5 through a gap between the lens array 2 and the opening 3 of the lens holder 1, the gap is sealed by a sealant 35 (e.g., silicon rubber).

Now, a reason for configuring the adhesion locations shown in FIGS. 3 and 5 is explained. The adhesion locations indicated therein are determined from experiments as adhesion locations, at which the change in straightness of the lens array becomes small during the later-discussed high temperature test of the LED head 15, in which both surfaces of the lens array 2 are adhered to the lens holder 1 by the UV adhesive as shown in FIG. 5.

First, to fix both end parts and the center part of the lens array 2, at which displacements by the warping of the lens array 2 are the largest, at least both end parts and the center part of the lens array 2 are defined as adhered locations. More preferably, to dissipate a peeling force applied to the adhesive, which is focused at any of the center part of edge parts of the lens array 2 due to warping or deformation, which occurs under a high temperature environment, of the lens array 2 adhered at the both end parts and center part, the adhesive is preferably applied to fix the lens array 2 at equal intervals between the center part and end parts of the lens array 2. Moreover, to dissipate the peeling force, the interval of the adhesive to fix the lens array 2 is preferably 40 mm or less.

Based on the above-described reason, on the lens array 2 having a length of 219 mm, the center part and both end parts are designated as the adhesion locations, in addition to two adhesion locations between the center part and end parts as shown in FIG. 5. Therefore, a total of 7 locations (12 locations on both sides) are adhered. Here, the adhesion locations on the lens array 2 are based on both end parts and the center part. However, with respect to the center part, the adhesion may be applied in the vicinity of the center part. In addition, with respect to both end parts, the adhesive may be applied in the vicinity of both end parts. In particular, more stable adhesion may be obtained when the adhesion is applied slightly inside from the end part of the lens part 2 because more adhesion area may be obtained. For example, similar effects are obtained when the adhesion is applied within 10 mm from the end parts or ±5 mm from the center part. Furthermore, the adhesion locations are preferably configured at the equal intervals in order to dissipate the peeling force generated by the warping of the lens array 2.

Even when the distance Lo and the distance Li (FIG. 3) are configured to be equalized by using the lens array 2, which is straitened to achieve the highly precise straightness by the above-described assembly method, and the LED head 15K, which includes the above-described eccentric cam mechanism, thermal stress occurs at the adhesion locations between the lens holder 1 and the lens array 2 when the LED head 15K is left in the high temperature environment, due to the difference in thermal expansion coefficients of the lens holder 1 and the lens array 2. As a result, the lens array 2 that is straitened to achieve the highly precise straightness may warp in a direction of the photosensitive drum 13K (FIG. 2). At this time, the position of the image formation by light on the surface of the photosensitive drum 13K is offset, causing decrease of the print quality.

Figure 6:
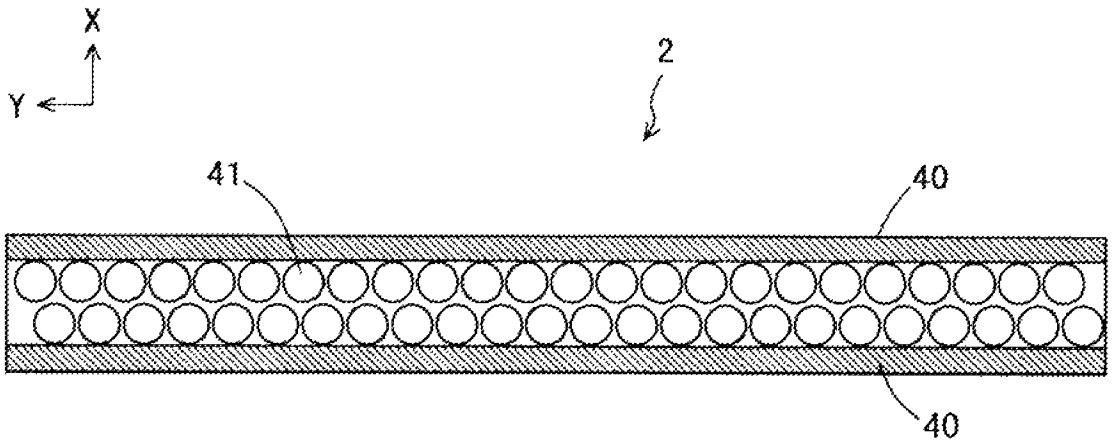
FIG. 6 is a schematic configuration diagram showing a top view of the lens array.

Here, a configuration of the lens array 2 is explained. FIG. 6 is a schematic configuration diagram showing a top view of the lens array 2.

As shown in the figure, the lens array 2 includes a pair of side plates 40 that are positioned to face each other and that are glass fiber epoxy resin laminated plates, and a plurality of lenses 41 that are positioned between the pair of side plates 40. As shown in FIG. 2, the plurality of lenses 41, which are distributed-index lenses, are arranged in two rows. In addition, each row of the lenses 41 is arranged so that the lenses 41 alternate with each other in the longitudinal direction (here, the Y axis direction). Moreover, an adhesive made from a silicon resin is filled and hardened in spaces between the lenses 41 and spaces between the side plates 40 and the lenses 41.

A general thermal explanation coefficient of the glass fiber epoxy resin laminated plate, which is the material for the side plates 40 of the lens array 2 that is adhered to the lens holder 1, is 12 to 14 ($10^{-6}$/° C.). The larger the difference between the thermal expansion coefficient of the lens array 2 and the thermal expansion coefficient of the base material of the lens holder 1, thermal stress generated at the adhered locations between the lens holder 1 and the lens array 2 becomes greater. Therefore, the warping of the lens array 2 and the peeling of the adhesive between the lens holder 1 and the lens array 2 occur when the LED head 15 is left in the high temperature environment.

Furthermore, in the image forming device 11, an acceptable range of the straightness of image formation by light on the photosensitive drum 13K is within 60 μm to obtain preferable printing results. For example, when the designed acceptable range of the flatness of the substrate contact surface 4 formed on the lens holder 1 is 30 μm, and when the designed acceptable range of the straightness of the lens array 2 at the time of fixing the lens array 2 using the above-described lens array adhesion jig 200 is 10 μm, the straightness of the image formation by light on the photosensitive drum 13K fluctuates within a range of 50 μm. Therefore, under the above-described conditions, the acceptable range of the warping amount of the lens array 2 that is necessary to always obtain preferable printing results, including when the LED head 15 is left in the high temperature environment, is within 10 μm. A smaller warping amount is more preferable.

In the LED head of the present embodiment, an adhesive with a property that sets the warping amount of the lens array 2 within 10 μm even under the later-discussed predetermined high temperature environment is selected and used as the adhesive 34. A method for selecting the adhesive 34 is explained below.

To select the adhesive 34, with a focus on an elongation measured using a Japanese Industrial Standard (JIS) No. 2 dumbbell test (hereinafter, referred to simply as elongation) and a hardness measured using Shore D test (hereinafter, referred to as hardness (Shore D)), test samples in which the lens holder 1 and the lens array 2 are adhered by adhesives having various elongations and hardnesses (Shore D) were provided, and an adhesive evaluation test was conducted that measured the warping amount after leaving the test samples under a high temperature environment.

Components and properties of the adhesives used in this adhesive evaluation test are explained. The adhesives used were acrylate adhesives, which are ultraviolet-hardening type UV adhesives and in which a glass filler and the like are filled as components. The hardness (Shore D) and the elongation were varied by adjusting the filled amount of the glass filler and the like. For example, the hardness and viscosity of the adhesive were controlled by adjusting the amount of the glass filler (a larger amount tends to increase the hardness and to decrease the viscosity). The elongation of the adhesive was controlled by adjusting the component of the acrylic base material (acrylate monomer and the like).

Primary test conditions for the adhesive evaluation test were as follows: 1) the adhesive used in the preset evaluation test was an ultraviolet-hardening type UV adhesive that has short hardening time; 2) the material of the side plates of the lens array 2 used in the present evaluation test was a glass fiber epoxy resin laminated plate having a thermal expansion coefficient of 12 to 14 ($10^{-6}$/° C.); 3) the lens holder 1 used in the present evaluation test was formed from an electrolytic zinc plated steel plate (thermal expansion coefficient: 11.7 ($10^{-6}$/° C.)) as the base material, which is relatively close to the thermal expansion coefficient of the lens array 2. The thermal expansion coefficients of the lens holder 1 and lens array 2 were approximately the same and were sufficient to be configured within a range of ±20%; 4) the length of the lens array 2 used in the present evaluation test was 219 mm, which corresponds to the A4 size; 5) with respect to the conditions of the high temperature environment in which the samples were left, the evaluation was made in a condition in which the test samples were left under a 70° C. environment for 96 hours; 6) the warping amount was calculated by measuring a state of the lens array 2 before and after leaving in the high temperature environment; and 7) the lens holder 1 and the lens array 2 were adhered at the locations explained in FIG. 5 (total of 14 locations).

Figure 7:
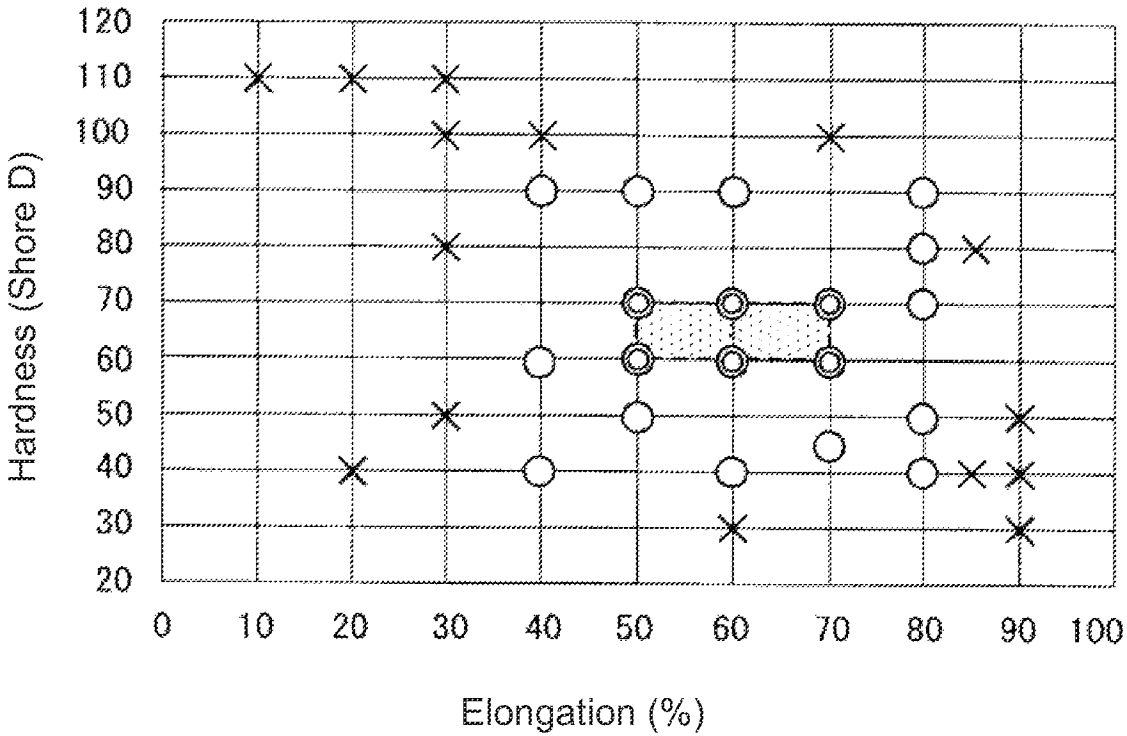
FIG. 7 is a relationship diagram illustrating an evaluation result of a warping amount in an adhesive evaluation test conducted with a plurality of test samples in which a lens holder and a lens array are adhered using adhesives having various elongations and hardnesses (Shore D) in the first embodiment.

FIG. 7 is a relationship diagram illustrating an evaluation result of warping amounts in an adhesive evaluation test conducted with a plurality of test samples in which the lens holder 1 and the lens array 2 were adhered using adhesives having various elongations and hardnesses (Shore D). The amounts of warping are evaluated using "◎," "○" and "x" in the relationship diagram in FIG. 7. "◎" indicates (warping amount) ≤5 μm. "○" indicates 5 μm<(warping amount)≤10 μm. "x" indicates that the warping amount is greater than 10 μm or that the adhesive had peeled.

Test samples of the adhesive for which the elongation and the hardness (Shore D) are measured are used after elapsing two or more hours after the adhesion. Because hardening of the adhesion used in the present embodiment stabilizes after elapsing two hours after the adhesion, the measurement results of the elongation and the hardness (Shore D) do not significantly change when two or more hours elapse after the adhesion. In addition, in the adhesive evaluation test shown in FIG. 7, an LED head, for which two or more hours have elapsed after the adhesion, is used.

While referring to the relationship diagram in FIG. 7, causes of the evaluation result "x" are discussed. (1) When the elongation is less than 40%, the straightness of the straitened lens array 2 (=straightness of the lens array contact surface 200*b* (FIG. 4)) when the lens array 2 and the lens holder 1 are adhered together can be maintained at the room temperature. However, the adhesive between the lens array 2 and the lens holder 1 peels off when left in the high temperature. (2) When the elongation is greater than 80%, the warping of the lens array 2 when the lens array 2 and the lens holder 1 are adhered together cannot be straitened in the room temperature. Therefore, the straightness of the lens array 2 cannot be maintained. That is, even when the lens array 2 is straitened by the lens array adhesion jig 200 (FIG. 4), this straitening cannot be maintained due to the adhesion. (3) When the hardness (Shore D) is greater than 90, the straightness of the straitened lens array 2 (=straightness of the lens array contact surface 200*b* (FIG. 4)) when the lens array 2 and the lens holder 1 are adhered together can be maintained at the room temperature. However, the adhesive between the lens array 2 and the lens holder 1 peels off when left in the high temperature. (4) When the hardness (Shore D) is less than 40, the warping of the lens array 2 when the lens array 2 and the lens holder 1 are adhered together cannot be straitened in the room temperature. Therefore, the straightness of the lens array 2 cannot be maintained. That is, even when the lens array 2 is straitened by the lens array adhesion jig 200 (FIG. 4), this straitening cannot be maintained due to the adhesion.

Therefore, the evaluation result of the above-described samples indicates the below tendency depending on the elongation and hardness of the adhesive. That is, when the adhesive is soft (when the elongation is large or when the hardness (Shore D) is low), the straightness of the lens array 2 cannot be maintained because the warping of the lens array 2 by itself cannot be straitened at the time of adhesion. On the other hand, when the adhesive is too hard (when the elongation is small or when the hardness (Shore D) is high), the adhesive easily peels off when left in the high temperature when a load is applied to the adhesive position due to a bimetal effect.

From the above, by using an adhesive having 40≤(hardness (Shore D))≤90 and 40%≤elongation≤80%, the straightness of the lens array 2 (=straightness of the lens array contact surface 200*b* (FIG. 4)) is maintained when the lens array 2 and the lens holder 1 are adhered in the room temperature. In addition, the warping amount of the lens array 2 in the direction of the photosensitive drum 13K is controlled within 10 μm even after leaving in the high temperature. As a result, preferable printing results can be obtained.

Moreover, from the relationship diagram shown in FIG. 7, by using an adhesive having 60≤(hardness (Shore D))≤70 and 50%≤elongation≤70%, the straightness of the lens array 2 (=straightness of the lens array contact surface 200*b* (FIG. 4)) is maintained when the lens array 2 and the lens holder 1 are adhered in the room temperature. In addition, the warping amount of the lens array 2 in the direction of the photosensitive drum 13K is controlled within 5 μm after leaving in the high temperature. When the hardness (Shore D) and the elongation are within the present ranges, theoretically up to 2 times of the width of 219 mm that correspond to the A4 size medium can be supported.

From these results, for the lens holder 1 of the present embodiment, an adhesive, which hardness (Shore D) is 40 to 90 and which elongation is 40% to 80%, that is capable of controlling the warping amount of the lens array 2 due to the change in the environmental temperature within 10 μm or less, is used as the adhesive 34 used for adhering the lens array 2. Furthermore, more preferably, for the lens holder 1 of the present embodiment, an adhesive which hardness (Shore D) is 60 to 70 and which elongation is 50% to 70%, that is capable of controlling the warping amount of the lens array 2 due to the change in the environmental temperature within 5 μm or less, is used as the adhesive 34 used for adhering the lens array 2.

In the present embodiment, an ultraviolet-hardening type adhesive is explained as the adhesive 34. However, other types of adhesive (e.g., epoxy or acrylic groups) may be used when such adhesive meets the same conditions. In addition, in the above-described test, the adhesive having the hardness (Shore D) of 60 to 70 and the elongation of 50% to 70%, which can control the warping amount of the lens array 2 having a length of 219 mm that corresponds to the A4 size medium within 5 μm, is effective for the lens array 2 having a length of 219 mm±30 mm.

As described above, according to the LED head of the present embodiment, the warping amount of the lens array 2 due to the change in the environmental temperature is controlled within 10 μm and further within 5 μm. Therefore, even when the designed acceptable range of the flatness of the substrate contact surface 4 on the lens holder 1 is set to 30 μm, and when the designed acceptable range of the straightness of the lens array 2 at the time when the lens array 2 is fixed using the lens array adhesion jig 200 is set to 10 μm, for example, the straightness of the image formation by light on the photosensitive drum 13K can be controlled within the acceptable range, or 60 μm. Moreover, when the warping amount of the lens array 2 due to the change in the environmental temperature is controlled within 5 μm, the above-described straightness of image formation is controlled within 50 μm, thereby increasing the accuracy of image formation. From these reasons, an LED head and an image forming device are provided with high accuracy and reliability regardless of the change in the environmental temperature.

Second Embodiment

Figure 8A:
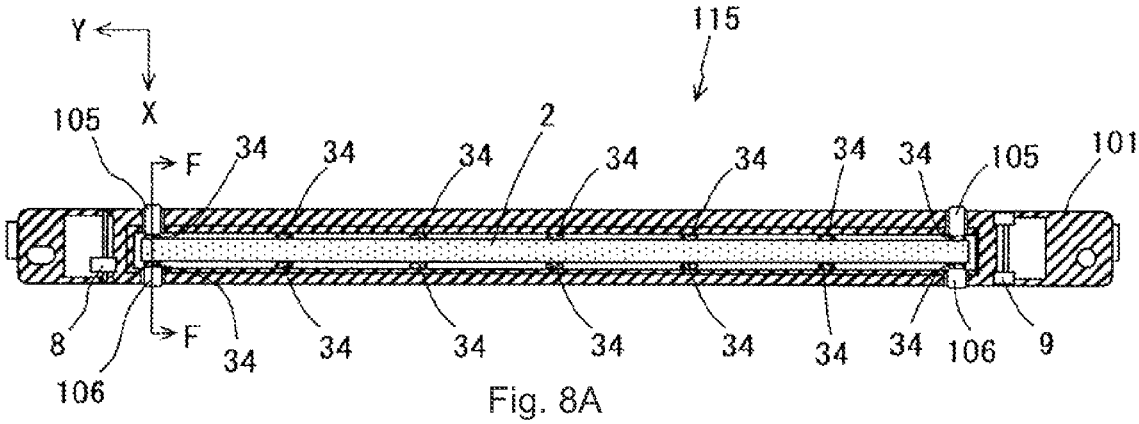
FIG. 8A is a schematic configuration diagram showing a bottom view of a main part configuration of an LED head of a second embodiment.
Figure 8B:
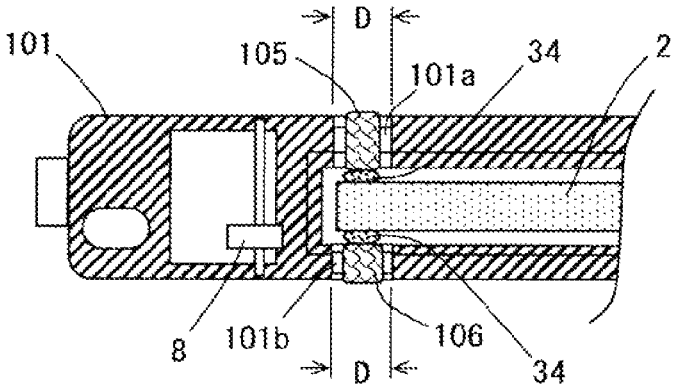
FIG. 8B is a partially enlarged view of a periphery of a left end part of the LED head in FIG. 8A.
Figure 8C:
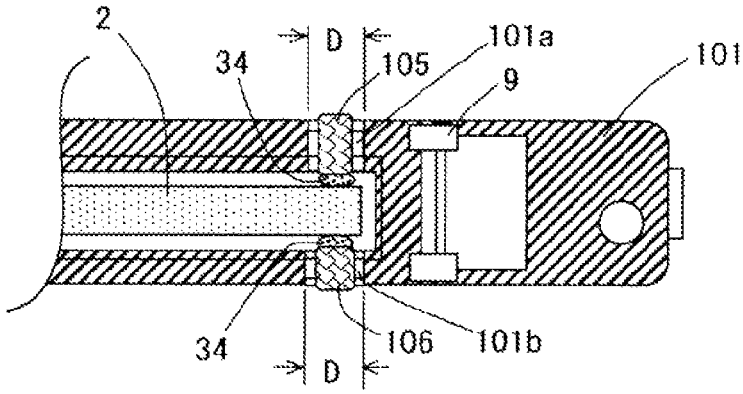
FIG. 8C is a partially enlarged view of a periphery off a right end part of the LED head in FIG. 8A.
Figure 9:
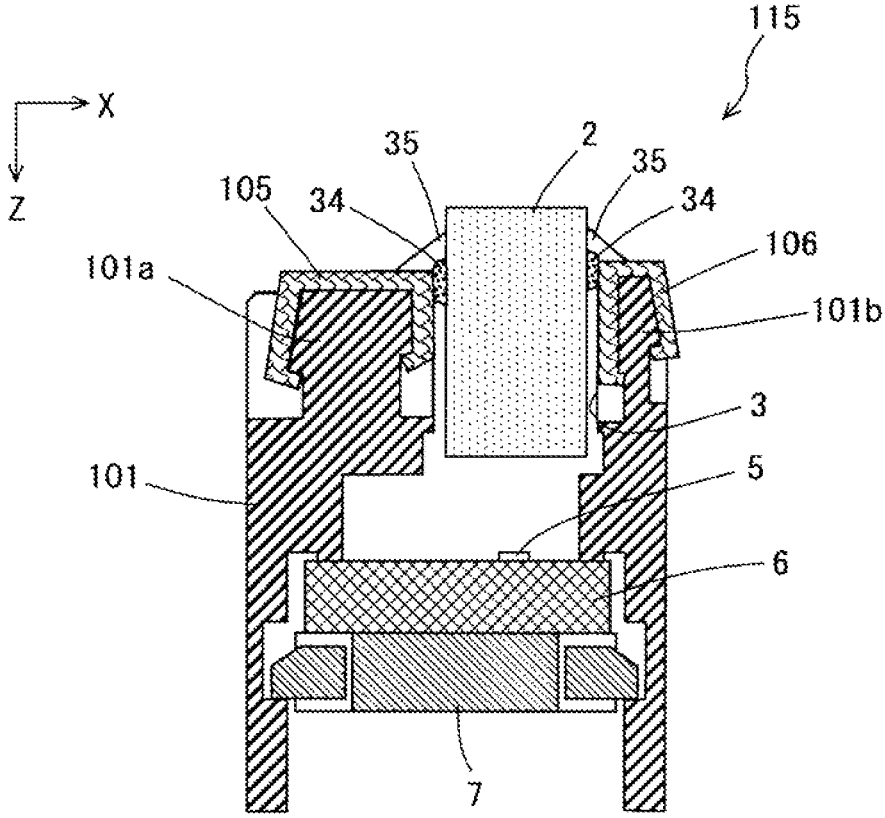
FIG. 9 is a main part cross-sectional view illustrating a main part cross-section of the LED head from a line F-F that passes through a clamp part shown in FIG. 8A.

FIG. 8A is a schematic configuration diagram showing a bottom view of a main part configuration of an LED head 115 of a second embodiment. FIG. 8B is a partially enlarged view of a periphery of a left end part of the LED head 115 in FIG. 8A. FIG. 8C is a partially enlarged view of a periphery off a right end part of the LED head 115 in FIG. 8A. In addition, FIG. 9 is a main part cross-sectional view illustrating a main part cross-section of the LED head 115 from a line F-F that passes through a clamp part 106 shown in FIG. 8A.

The difference of an image forming device that uses the LED head 115 from the above-described LED head 15 of the first embodiment shown in FIGS. 2 and 3 is an addition of clamps 105 and 106 as sliding parts. Therefore, explanations of parts of the image forming device that uses the LED head 115, which are common with the parts of the above-described image forming device 11 (FIG. 1) of the first embodiment, are omitted by assigning the same reference numbers or by removing from the drawings. Explanations are focused on the difference. Moreover, the main part configuration of the image forming device of the present embodiment is common with the main part configuration of the image forming device 11 of the first embodiment shown in FIG. 1, except the LED head 115. Therefore, FIG. 1 is referred to as needed.

In the case of the above-described LED head 15 of the first embodiment (see FIG. 5), when the lens holder 1 and the lens array 2 are fixed to each other by the adhesive 34, the lens array 2 is directly adhered to the lens holder 1 at predetermined intervals including both end parts of the lens array 2, in the longitudinal direction (Y axis direction) of the lens array 2. This is a process necessary to fix the lens array 2 to the lens holder 1 while maintaining the straightness of the lens array 2. However, with such an adhesion method, the thermal stress applied to the adhered parts of the lens holder 1 and the lens array 2 that occurs when left in the high temperature environment due to the difference in the thermal expansion coefficients of the lens holder 1 and the lens array 2 becomes greater at the adhesion locations at both end parts of the lens array 2 than at the adhesion location at the center part of the lens array 2.

As a result, it tends that the adhesion between the lens holder 1 and the lens array 2 is more easily peels off at both end parts of the lens array 2 compared with the center part of the lens array 2. When the adhesive between the lens holder 1 and the lens array 2 peels off, the lens array 2 may warp in the direction of the photosensitive drum 13. As a result, the condition of image formation by light on the photosensitive drum 13 may change, affecting the printing quality.

In the present embodiment, by performing the adhesion of the lens holder 101 and both end parts of the lens array 2 between the lens array 2 and clamps 105 and 106 that engage with the lens holder 101, the thermal stress caused at the adhesion locations at both end parts of the lens array 2 due to the difference in the thermal expansion coefficients of the lens holder 101 and the lens array 2 is reduced. This configuration is explained below.

The adhesion by the adhesive 34 is performed at 7 locations (total of 14 locations) between an upper end part (shown upside down in FIG. 9) of the opening 3 of the lens holder 101 and the lens array 2 as shown in FIG. 9 and at opposing positions on both sides of the lens array 2 in the lateral direction at approximately equal intervals in the longitudinal direction including both end parts and the center part of the lens array 2, as shown in FIG. 8A. However, the adhesion is applied between the lens array 2 and the clamps 105 and 106 arranged at opposing positions at both end parts in the longitudinal direction and is applied directly between the lens holder 101 and the lens array 2 at other locations.

As shown in FIGS. 8B, 8C and 9, at the positions of the lens holder 101 that face both end parts of the lens array 2, two pairs of projections 101*a* and protrusions 101*b* having a width D are formed, which is inserted into the clamps 105 and the clamps 106, respectively to clamp the clamps 105 and the clamps 106. The clamps 105 that have a width narrower than the width D and the clamps 106 that also have a width narrower than the width D are attached to the projections 101*a* and the projections 101*b*, respectively, prior to the adhesion by the adhesive 34. As shown in FIG. 9, the clamps 105 and the clamps 106 are attached so as to respectively sandwich the projection 101*a* and the projection 101*b* and are attached so that the clamps 105 and the clamps 106 cannot move in the vertical direction (Z axis direction). As shown in FIGS. 8B and 8C, the clamps 105 and the clamps 106 are held in a region of the width D of the projections 101*a* and the projections 101*b* by the lens holder 101 so that the clamps 105 and the clamps 106 can slide only in the longitudinal direction (Y axis direction) of the lens holder 101.

Similar to the case of the first embodiment, when the lens array 2 is fixed to the lens holder 101, the lens array adhesion jig 200 that includes the lens array contact surface 200*b* with straightness as shown in FIG. 4 is used. The lens array 2 is fixed to the lens holder 101 by using the adhesive 34 (here, UV adhesive) with short hardening time at the above-described locations of the lens holder 101, while straitening and maintaining the straightness of the lens array 2. After that, to prevent light or a foreign material from flowing onto the LED array chip 5 through a gap between the lens array 2 and the opening 3 of the lens holder 101, the gap is sealed by a sealant 35 (e.g., silicon rubber).

Figure 10:
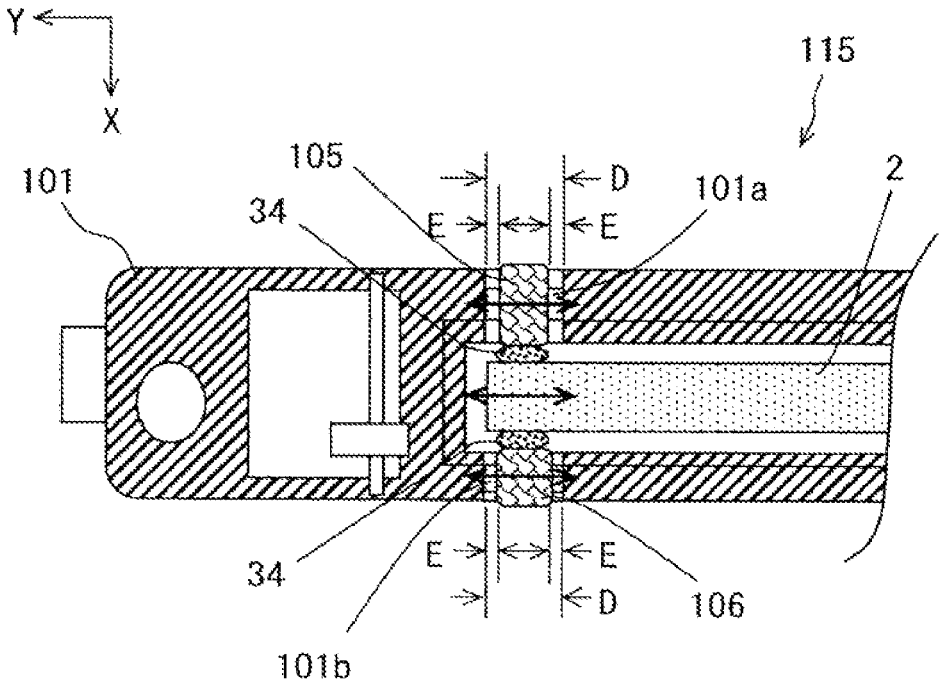
FIG. 10 is an operation diagram for explaining a behavior of the LED head when the LED head is left under a high temperature environment in the second embodiment.

FIG. 10 is a partially enlarged view of the periphery of the left end part of the lens holder 101 shown in FIG. 8A and is an operation diagram for explaining a behavior of the LED head 115 when the LED head 115 is left under a high temperature environment. The behavior of the LED head 115 when the LED head 115 is left in the high temperature environment is explained with reference to FIG. 10.

As described above, the clamps 105 and 106 are formed with a width that is narrower than the width D of the projections 101*a* and 101*b*, respectively, and are configured to be slidable in an area allowed by spaces E created by the difference in the widths. In the meantime, when the LED head 115 is left in the high temperature environment, thermal stress occurs at the adhered parts of the lens holder 101 and the lens array 2 due to the difference in the thermal expansion coefficients of the lens holder 101 and the lens array 2. At that time, as a result of such effect, both end parts of the lens array 2 particularly tend to move in the longitudinal direction (direction indicated by arrows in FIG. 10) of the lens holder 101 as shown in FIG. 10. In the lens holder 101, because both end parts of the lens array 2 are fixed to the above-described clamps 105 and 105 by the adhesive 34, the clamps 105 and 106 move in the arrow directions in FIG. 10 in accordance with the movement of both end parts of the lens array 2. Therefore, the clamps 105 and 106 act to reduce effects by thermal stress that occurs at the adhesion locations at both end parts of the lens array (occurrence of the warping of the lens array 2 or the peeling of the adhesive).

As described above, according to the LED head of the present embodiment, effects by thermal stress that occurs at the adhesion locations between the lens holder 101 and both end parts of the lens array 2 due to the change in the environmental temperature is reduced, and thereby the peeling off of the adhesive by the thermal stress and the warping of the lens array 2 in the direction of the photosensitive drum, which often occur particularly at both end parts of the lens array 2, are controlled. Therefore, the change of the condition of image formation by light on the photosensitive drum is minimized regardless of the change in the environmental temperature. Accordingly, the LED head and the image forming device are provided with high accuracy and reliability.

In each of the above-described embodiments, the explanations are made with a printing device as an example. However, the configuration is not limited to those described above, and may be applied to a facsimile machine, a photocopier, and a multifunction peripheral (MFP).

What is claimed is:

1. An exposure device, comprising:

an optical system member that causes light irradiated from a light emitting element to converge;

an optical system support part that supports the optical system member; and a first fixing member configured to fix the optical system member to the optical system support part, wherein an elongation of the first fixing member is in a range of 40% to 80% inclusive, and a hardness (Shore D) of the first fixing member is in a range of 40 to 90 inclusive, the first fixing member is configured such that a warping of the optical system member is maintained within an allowable range when the exposure device is exposed to a high-temperature environment for an extended period of time, and the first fixing member is configured such that a straightness of the optical system member is maintained within an allowable range even when left under a high-temperature environment for an extended period of time.

2. The exposure device of claim 1, wherein the elongation of the first fixing member is in a range of 50% to 70% inclusive, and the hardness (Shore D) of the first fixing member is in a range of 60 to 70 inclusive.

3. The exposure device of claim 1, wherein the optical system support part holds sliding parts slidably arranged in correspondence with both end parts of the optical system member at a vicinity of the both end parts, and the vicinity of the both end parts of the optical system member is fixed to the sliding parts by the first fixing member, and a vicinity of a center part of the optical system member is directly fixed to a main body of the optical system support part by the first fixing member.

4. The exposure device of claim 3, wherein the optical system support part and the optical system member are fixed to each other between the vicinity of the both end parts of the optical system member and the vicinity of the center part of the optical system member.

5. The exposure device of claim 1, wherein fixing locations of the optical system support part and the optical system member include at least a vicinity of the both end parts and a vicinity of a center part of the optical system member.

6. The exposure device of claim 5, wherein the optical system support part and the optical system member are fixed to each other between the vicinity of the both end parts of the optical system member and the vicinity of the center part of the optical system member.

7. The exposure device of claim 1, wherein the fixing member is an UV adhesive.

8. The exposure device of claim 7, wherein the UV adhesive includes a glass filler.

9. The exposure device of claim 1, wherein the optical system member is a lens array.

10. The exposure device of claim 9, wherein a thermal expansion coefficient of the optical system member and a thermal expansion coefficient of the optical system support part are approximately the same.

11. The exposure device of claim 10, wherein a material of side plates of the lens array is a glass fiber epoxy resin laminated plate having a thermal expansion coefficient of 12 to 14 (10–6° C.), and a base material of the optical system support part is an electrolytic zinc plated steel plate having a thermal expansion coefficient of 11.7 (10–6° C.).

12. The exposure device of claim 1, wherein the optical system support part includes a substrate contact surface on which a substrate including the light emitting element is mounted, an acceptable range of a flatness of the substrate contact surface is 30 μm, and an acceptable range of a straightness of the optical system member at the time when the optical system member is fixed to the optical system support part is 10 μm.

13. The exposure device of claim 1, wherein the light emitting element is a light emitting diode (LED).

14. An image forming device, comprising:

the exposure device of claim 1.

15. The exposure device of claim 1, wherein
the extended period of time is 96 hours or more.

16. The exposure device of claim 1, wherein
the allowable range of warping is less than or equal to 10 μm.

17. The exposure device of claim 1, wherein
the high-temperature environment is at a temperature greater than or equal to 70° C.

18. The exposure device of claim 1, further comprising
a second fixing member configured to fix the optical system member to the optical system support part; and
a sealant formed between the first and the second fixing members,
wherein
an elongation of the second fixing member is in a range of 40% to 80% inclusive, and a hardness (Shore D) of the second fixing member is in a range of 40 to 90 inclusive.

19. The exposure device of claim 1, further comprising
second through $N^{th}$ fixing members configured to fix the optical system member to the optical system support part; and
a sealant formed between adjacent pairs the first through $N^{th}$ fixing members,
wherein
an elongation of the second through $N^{th}$ fixing members is in a range of 40% to 80% inclusive, and hardness (Shore D) of the second through $N^{th}$ fixing members is in a range of 40 to 90 inclusive.

20. An exposure device, comprising:
an optical system member that causes light irradiated from a light emitting element to converge;
an optical system support part that supports the optical system member; and
a fixing member for fixing the optical system member to the optical system support part, wherein
the optical system support part holds sliding parts that is are arranged in correspondence with both end parts of the optical system member at a vicinity of the both end parts and that are slidable in a longitudinal direction, and
the vicinity of the both end parts of the optical system member is fixed to the sliding parts by the fixing member, and
a vicinity of a center part of the optical system member is directly fixed to a main body of the optical system support part by the fixing member.

21. The exposure device of claim 20, wherein
the light emitting element is a light emitting diode (LED).

22. An image forming device, comprising:
the exposure device of claim 20.

23. An exposure device, comprising:
an optical system member that causes light irradiated from a light emitting element to converge;
an optical system support part that supports the optical system member;
a first fixing member configured to fix the optical system member to the optical system support part;
a second fixing member configured to fix the optical system member to the optical system support part; and
a sealant formed between the first and the second fixing members,
wherein
an elongation of the first fixing member is in a range of 40% to 80% inclusive, and a hardness (Shore D) of the first fixing member is in a range of 40 to 90 inclusive, and
an elongation of the second fixing member is in a range of 40% to 80% inclusive, and a hardness (Shore D) of the second fixing member is in a range of 40 to 90 inclusive.

* * * * *